US005474452A

United States Patent [19]

Campagnuolo

[11] Patent Number: 5,474,452

[45] Date of Patent: Dec. 12, 1995

[54] TRAINING SIMULATION SYSTEM FOR INDIRECT FIRE WEAPONS SUCH AS MORTARS AND ARTILLERY

[75] Inventor: Carl J. Campagnuolo, Potomac, Md.

[73] Assignee: The United States of America as represented by the Secretary of the Army, Washington, D.C.

[21] Appl. No.: 205,443

[22] Filed: Mar. 4, 1994

[51] Int. Cl.[6] ..... G09B 19/00

[52] U.S. Cl. ..... 434/11; 434/16; 273/311; 102/401

[58] Field of Search ..... 434/11, 12, 14–23; 102/401–404, 407, 409, 410; 273/348, 371, 372, 310–316

[56] References Cited

U.S. PATENT DOCUMENTS

| | | | |
|---|---|---|---|
| 4,409,899 | 10/1983 | Owen et al. | 102/211 |
| 4,695,058 | 9/1987 | Carter et al. | 434/16 |
| 4,744,761 | 5/1988 | Doerfel et al. . | |
| 4,823,401 | 4/1989 | Gammarino . | |
| 5,074,793 | 12/1991 | Hambric et al. | 434/12 X |
| 5,199,874 | 4/1993 | Campagnuolo et al. . | |
| 5,207,579 | 5/1993 | Campagnuolo . | |
| 5,292,254 | 3/1994 | Miller et al. | 434/11 |

OTHER PUBLICATIONS

Lab Designs Life–Saving Training Aids Soldier magazine—author and date unknown at this time.

FUTABA Digital Proportional Radio Control Eight page Instruction Manual, FUTABA Corp. of Irvine, California, date unknown at this time.

*Primary Examiner*—Richard J. Apley
*Assistant Examiner*—Glenn E. Richman
*Attorney, Agent, or Firm*—Freda L. Krosnick; Frank J. Dynda

[57] ABSTRACT

A system for simulating indirect weapon fire is disclosed which serves to greatly increase the realism and training value of tactical engagement simulation exercises when suitably interfaced with existing MILES-type detecting/indicating equipment. System simplicity, effectiveness, and security are achieved using a referee-operated, hand-held actuating device emitting at a first acoustic frequency to selectively transmit actuating signals to one or more pre-positioned explosion simulation devices, which then transmit multidirectional sound at a second acoustic frequency. MILES-equipped point targets located within the effective range of the multidirectional sound respond to the second frequency signal and determine the effectiveness of the simulated explosion using a pre-established hierarchy of hit/near miss/weapon-type criteria. The system further provides additional realism to the tactical situations by the inclusion of synchronized light and sound to simulate firing and exploding of nondirectional weapons such as mortars and artillery shells, and further provides operational versatility via an alternate embodiment using encoded RF signals for actuating the explosion simulation devices.

7 Claims, 2 Drawing Sheets

TRAINING SIMULATION SYSTEM FOR INDIRECT FIRE WEAPONS SUCH AS MORTARS AND ARTILLERY

RIGHTS OF THE GOVERNMENT

The invention described herein may be manufactured, used, and licensed by or for the United States Government for governmental purposes without payment to us of any royalty thereon.

BACKGROUND OF THE INVENTION

1. Field of the Invention

The present invention relates generally to explosive device simulation systems for use in military training exercises and, more particularly, for methods and apparatus for simulating the effects of indirect and/or non-directional weapon fire in tactical electronic combat training environments.

2. Description of the Prior Art

The introduction of the MILES system has changed the way the military trains for combat. The word MILES is an acronym for "Multiple Integrated Laser Engagement System." The MILES system has been fielded with armies of many nations around the world and has become the international standard against which all other Tactical Engagement Simulation (TES) systems are measured. For the U.S. Army and Marine Corps, MILES is the keystone for their opposing force, free-play TES Program. It is highly valued in its ability to accurately assess battle outcomes and to teach soldiers the skills required to survive in combat and destroy the enemy.

Briefly, the MILES system uses laser bullets in combination with laser sensitive detectors to simulate the lethality and realism of the modern tactical battlefield. Eye-safe Gallium Arsenide (GaAs) laser transmitters, capable of shooting pulses of coded infrared energy, simulate the effects of live ammunition. The transmitters are easily attached to and removed from all hand-carried and vehicle-mounted direct-fire weapons. Detectors located on opposing force troops, vehicles, and other point targets receive the coded laser pulses. MILES decoders then determine whether the target was hit by a weapon that could cause damage in a hierarchy of weapons effects and whether the laser bullet was accurate enough to cause a casualty. The target vehicles or troops are made instantly aware of the accuracy of the simulated shot by means of audio alarms and visual displays, which can indicate either a hit or a near miss.

In use, the coded laser (infrared) energy is received by silicon detectors located on the point targets. In the case of ground troops, the detectors are installed on webbing material that resembles the standard-issue load-carrying lift harness. Additional detectors are attached to a web band that fits on standard-issue helmets. For vehicles, the detectors are mounted on belts that easily attach to the front, rear, and sides. The detectors provide 360-degree coverage in azimuth and sufficient elevation coverage to receive the infrared energy during an air attack. The arriving pulses are sensed by detectors, amplified, and then compared to a threshold level. If the pulses exceed the threshold, a single bit is registered in the MILES detection logic. Once a proper arrangement of bits exists, corresponding to a valid code for a particular weapon, the decoder decides whether the code is a near miss or a hit. If a hit is registered, a hierarchy decision is then made to determine if this type of weapon can indeed cause a kill against this particular target and, if so, what the probability of kill might be.

With MILES, commanders at all levels can conduct opposing force free-play tactical engagement simulation training exercises that duplicate the lethality and stress of actual combat. However, existing MILES training systems have been largely limited to simulating combat situations involving direct, line-of-sight weapons fire.

In presently existing military training environments, indirect fire from mortars, artillery, and the like non-directional weapons are often simulated by physically placing devices in the battle area. These devices at the pre-planned time for artillery/mortar fire are hand-placed into the area and referees decide which soldiers or vehicles in the battle are eliminated. More advanced systems, such as the one described in U.S. Pat. No. 4,744,761 to Doerfel et al., propose to inject timed RF signals into the battle zone, so soldiers or vehicles exposed to the RF signal will be "eliminated" through activation of their MILES II system. The MILES II system differs from the MILES system in that it also interacts with RF signals. Though both approaches provide means to train, both lack realism in their execution. In one case, the war game participants see a flash, in others they sense the interaction of an RF signal with their MILES system. As will be later seen, the teachings of the present invention will provide a flash (explosion) upon command and an interactive means with the MILES-type harness found on soldiers or vehicles.

Other systems for injecting increased degrees of realism into simulated weapon fire exercises are disclosed in U.S. Pat. Nos. 5,207,579 to Campagnuolo and 5,199,874 to Campagnuolo et al.—both assigned to the same assignee as the present invention, the U.S. Government. In the '579 patent the effects of an antipersonnel mine are simulated by having a MILES system located on a target respond to the acoustic output of the mine upon simulated detonation initiated by conventional physical contact/trip-wire means. In the '874 patent, an acoustic receiver for use with a MILES-type tactical simulation system is described that incorporates preexisting anti-tampering circuitry as part of the acoustic detection technique.

Up to the present time, it has been difficult to include the effects of a MILES grenade into realistic tactical simulations since the grenade effects are non-directional and hence would require many laser emitters to ensure that at least one beam would be pointed to the target. Similar problems are encountered with the other types of non-directional weapons. Because of these difficulties, no truly suitable system to simulate non-directional or indirect weapon fire are presently available.

SUMMARY OF THE INVENTION

It is therefore a primary object of the present invention to provide improved methods and apparatus for training military personnel under simulated combat conditions which will overcome the disadvantages and limitations of the prior art weapon simulation systems.

A further major object of the present invention is to provide a system that simulates the effects of indirect fire that is capable of interacting with acoustic versions of existing MILES systems.

A yet further object of the present invention is to provide a system that faithfully simulates the effects of non-directional and indirect weapon fire for use in military training exercises.

A still further object of the present invention is to provide realistic simulation of active weapons such as hand grenades, mortars, artillery shells, Claymore Mines, Bouncing Bettys, and the like, for use in tactical electronic personnel training.

By means of a basic preferred embodiment and a number of related alternate embodiments, the present invention teaches methods and apparatus for greatly increasing the realism and training value of a system for simulating indirect and/or non-directional weapon fire in environments allowing functional interfacing with existing MILES-type equipment. A basic embodiment teaches the use of two acoustic frequency ranges for implementing the two transmission paths required to simulate a selectively actuated explosion and acoustic detection of that explosion for making a hit/miss determination. The two acoustic frequency ranges may be chosen to further simulate the firing and en route sounds associated with a particular indirect weapon, and also the simulated explosion sound of that particular weapon. Additional circuitry provides realism to the simulated explosion sound by including sequenced visual flashes to accompany the acoustic simulation. Additionally, an alternate embodiment teaches the use of an RF actuating signal to selectively actuate the explosion simulation devices to increase system range as well as to improve system flexibility and security.

BRIEF DESCRIPTION OF THE DRAWINGS

Additional objects and advantages of the invention will become apparent to those skilled in the art as the description proceeds with reference to the accompanying drawings wherein.

DETAILED DESCRIPTION OF THE PREFERRED EMBODIMENTS

Figure 1:
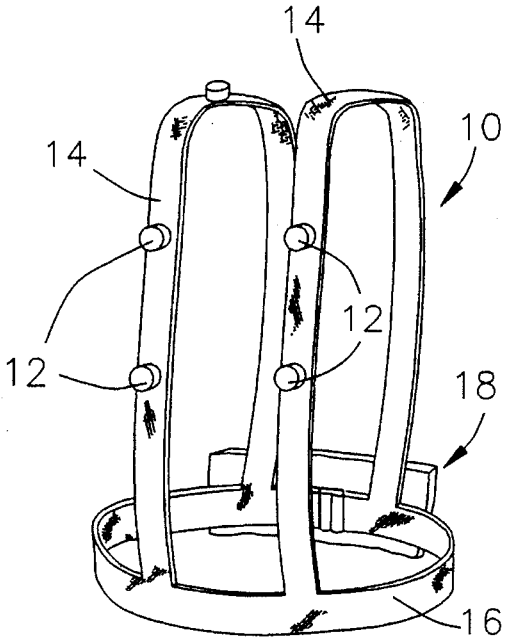
FIG. 1 is a perspective view of a MILES-type harness suitable for use with the present invention.
Figure 2:
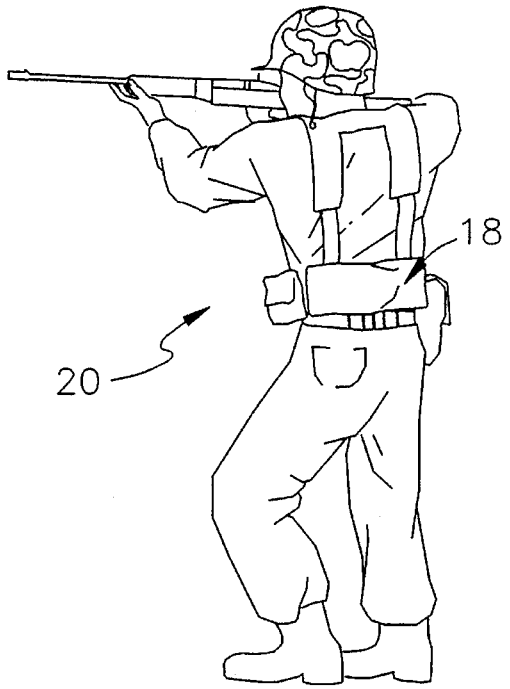
FIG. 2 is a pictorial view of the MILES-type harness as worn by a soldier/trainee.

Referring now to FIGS. 1 and 2, there is shown a stand-alone view of a basic MILES harness and a soldier wearing the harness during simulated combat. The harness 10 has a plurality of detectors 12 arrayed along the outer surfaces of a pair of shoulder straps 14 secured to a waistband 16. The harness further includes a control box 18 affixed to the waistband 16, all of which is carried on the torso of the soldier/trainee 20, as shown in FIG. 2. The control box 18 includes all of the MILES harness electronics and a battery. As is evident from the above description, to communicate with the harness 10 one must have a laser pulse that is fired from a gun that can be pointed toward a target.

Figure 3:
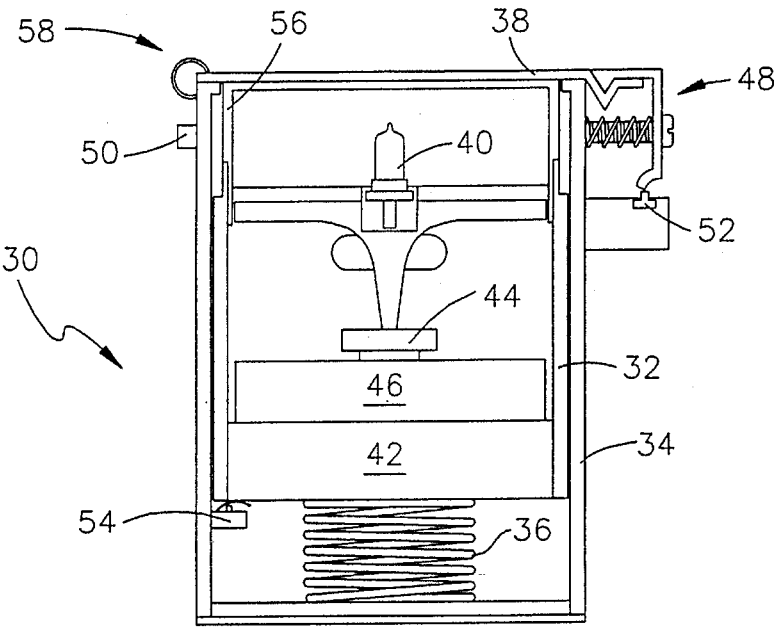
FIG. 3 is a simplified schematic representation of an explosion simulation device according to the present invention.

Referring now to FIG. 3, there is shown a simplified schematic view of an explosion simulation device portion of the present invention. In a preferred basic embodiment, the device 30 consists of a pair of concentric cylinders, one inserted into the other. An inner cylinder 32 is connected to an outer cylinder 34 by means of a helical spring 36. When the inner cylinder 32 is in the stowed position, a hold-down/latch mechanism 38 traveling across the top of the outer cylinder 34 holds the inner cylinder 32 in the down or stowed position as shown. The inner cylinder 32 also contains a flash bulb 40 powered by a battery 42 and a high frequency acoustic transducer 44 driven at a predetermined, selectable frequency. Electronic control circuitry 46, located in the inner cylinder, serves to accept and process remotely originated signals and operate a lock mechanism 48 that retains the inner cylinder 32 stowed within the outer cylinder 34. When the remotely originated actuating signal is sensed at the explosion simulator device 30 via one or more multidirectional microphones 50, the control circuitry 46 serves to detect the signal, process it, and, when appropriately recognized, activate a solenoid 52 which unlatches the lock mechanism 48. At this instant, the inner spring 36 pushes the inner cylinder 32 upward. A microswitch 54, which was being held in the "off" position when the inner cylinder 32 was in the stowed position, now transitions to its "on" position (i.e., its contacts open) and allows the battery voltage to fire the flash bulb 40 through a firing circuit included as part of the electronic circuitry 46. One or more bulbs 40 may be used, and flashing of the bulb(s) 40 activates the high frequency acoustic transducer 44 (alternately called a buzzer), which may then be acoustically detected by MILES-type equipment worn by one or more soldiers in the nearby battle zone. A MILES harness (including a helmet when appropriate) adapted to respond to acoustic signals via multidirectional input acoustic detectors (as compared to the array of detectors 12 of FIG. 1 which are sensitive to laser light) that is tuned to the predetermined frequency of the explosion simulation device 30 will cause the MILES system indicator to sound off a hit signal. Trucks, vehicles, or other point targets in the battle area that may be furnished with a MILES harness capable of detecting the predetermined acoustic frequency from the simulator device 30 will also sound a hit.

As previously described, the simulation device 30 may be operated remotely by a referee by the use of an RF signal or an acoustical signal generated by an actuating emitter. In the illustrative embodiment of FIG. 3, an acoustic source is used. The acoustic source provides additional credence to the battle scene since the triggering frequency can be chosen to simulate the sound that a projectile makes as it flies through the air so that the trainees are warned that simulated artillery/mortar shells are on the way. The referee can be located a considerable distance from the battle area (several hundred feet) and holds in his hand the actuating sound emitter. An upper portion of the inner cylinder 32 is formed as a cylindrical flash housing 56, made of transparent plastic so that the flash can pass through it. The battery 42 that powers the device 30 may be alkaline, rechargeable nickel cadmium, or lithium. In an alternate embodiment, the battery 42 can also be recharged by a solar array (not shown) located either above the outer cylinder 34, or by a solar panel located adjacent to the device.

Figure 4:
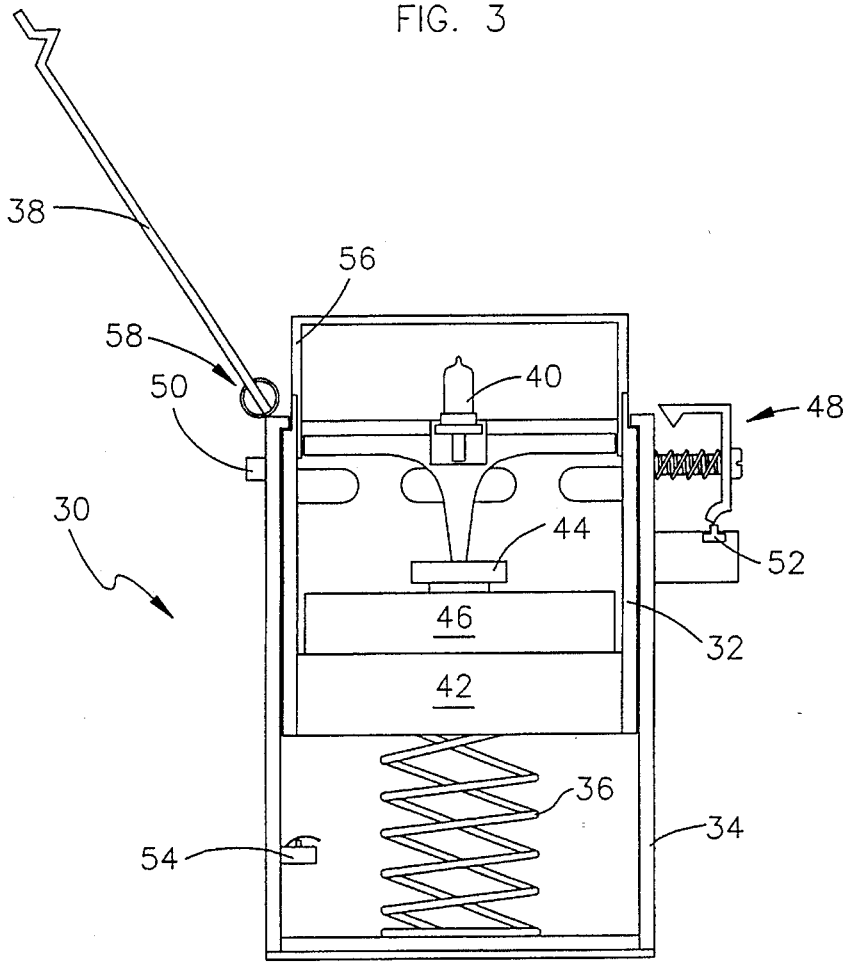
FIG. 4 shows the explosion simulation device portion of the present invention in its deployed condition.

Brief reference to FIG. 4 shows the explosion simulation device 30 in its activated condition: solenoid 52 actuated; lock mechanism 48 tripped; hold-down latch/cover 38 articulated around a hinge assembly 58; the inner cylinder 32 upwardly deployed by extended coil spring 36; microswitch 54 released; and both flash bulbs 40 and acoustic buzzer 44 emitting under control of the electronic control circuitry 46.

Figure 5:
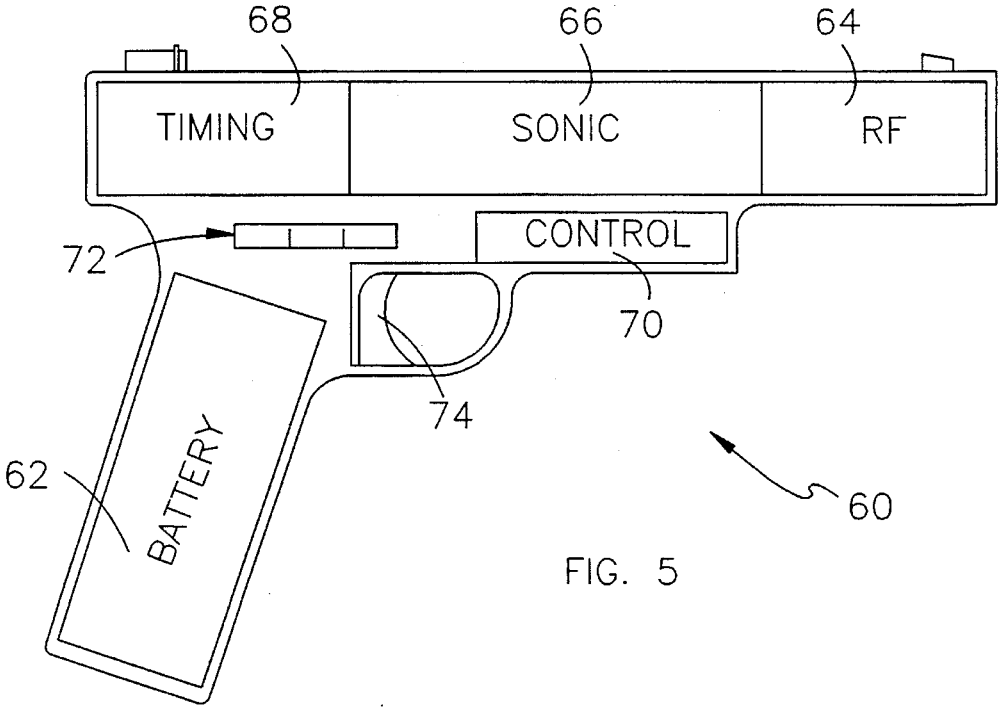
FIG. 5 shows a hand-held actuating signal emitter according to the present invention.

FIG. 5 shows a hand-held actuating signal emitter portion of the present invention in highly schematic form. As shown, the actuating emitter is shaped as a conventional handgun that is operated usually by a referee who participates and, to some extent, directs the tactical engagement simulation by selectively actuating explosion simulation devices in accordance with predetermined rules and instructions. In a preferred embodiment the actuating emitter 60 includes a battery 62 that powers several control and emitting sections. An RF output section 64 located in the forward barrel portion houses tunable RF oscillator/power amplifier/antenna circuitry for serving—when called for—as the actuating signal for the explosion simulator portions of the simulator system. A central portion 66 of the barrel contains selectably tunable sound oscillator/amplifier circuitry plus output transducers for providing—when called for—the actuating signal for the explosion simulator, as well as audible output signals for simulating the firing sounds of various types of indirect weapons. A rear portion 68 of the barrel houses various timing circuitry required to produce the required pulse coding, pulse width, pulse repetition frequency, and the like timing signals, while a lower central portion 70 of the gun frame houses the switching and control circuitry which allows the user/referee to control the various operating modes by manipulating one or more input switches 72 and an actuation trigger 74.

Functionally, when an actuating signal (either RF or acoustic) is transmitted via the hand-held emitter 60 by a referee, the actuating signal may be received by the microphone 50 on one or more explosion simulating devices 30. Beyond the single microphone version of the device 30 shown in FIGS. 3 and 4, other microphones may be arranged around the upper portion of the outer cylinder 34, and the one or more microphones 50 may be implemented using conventional hearing aids. In an alternate preferred embodiment wherein the referee emitted actuating signal is an encoded RF signal at predetermined frequencies, the one or more microphones 50 of FIGS. 3 and 4 are merely replaced by one or more suitable positioned RF antenna.

Details of the electronic control circuitry 46 in each device 30 may be taken from the description set forth in the aforementioned U.S. Pat. No. 5,207,579 to Campagnuolo, issued on May 4, 1993. The teachings of this '579 patent are incorporated by reference herein, and the interested reader is particularly referred to the description associated with FIGS. 4 and 4A of '579 regarding the control of one or more flash bulbs (elements 40 in the present invention) and the acoustic sound generator (element 44 in the present invention); and also the description associated with FIG. 7 of '579 regarding the receiver/processor circuitry (element 46 in the present invention).

As previously described, actuation of the explosion simulating device 30 may be done using acoustic or RF actuating signals. The RF technology required to implement the present system is readily available using existing commercial equipment. The interested reader is referred to an off-the-shelf Digital Proportional Radio Control brochure describing a FD-4NBP equipment sold by the FUTABA Corporation of America, based in Irvine, Calif. The brochure describes an RF control system having greater capabilities than required by the present invention. The receiver shown therein, for instance, can operate four servo motors, as compared to the single solenoid (or alternately servo motor) needed to trip the lock mechanism 48 in the present invention.

In the previously described embodiment using acoustic actuating signals, the sound oscillator/amplifier circuitry of portion 66 is used to simulate the incoming projectile and also to activate the explosion simulation device(s) 30. Those experienced in the art will quickly recognize that the embodiment using RF can operate over longer distances, while the sound operated device is used for closer distances, such as 50 to 100 meters. In the case of the acoustic embodiment, the emitted sound frequency (or frequencies) for device actuation is separated from the frequency (or frequencies) emitted by the explosion simulating device so that no interference of false alarm is produced.

Although the present invention has been described in terms of selected preferred embodiments, the invention should not be deemed limited thereto, since other embodiments and modifications will readily occur to one skilled in the art. It is therefore to be understood that the appended claims are intended to cover all such modifications as fall within the true spirit and scope of the invention.

What is claimed is:

1. A method for simulating the effects of indirect weapons in a tactical engagement environment for use with a MILES-type detector/indicator responsive to multidirectional acoustic actuating signals, comprising:

(a) placing at least one explosion simulator in a predetermined fixed location for producing a multidirectional acoustic actuating signal in a first frequency range in response to receipt of an actuating signal;

(b) providing an actuating emitter for use by an operator for generating and transmitting an actuating signal to said at least one explosion simulator;

(c) providing at least one detector/indicator on one or more fixed or movable point targets for receiving and processing said multidirectional acoustic actuating signal and for indicating degrees of effectiveness of said simulated indirect weapon fire.

2. The method of claim 1 wherein said first frequency range further provides a simulated indirect weapon explosion sound in an audible range.

3. The method of claim 2 wherein said explosion simulator further provides a simulated indirect weapon explosion flash in timed relation with said explosion sound.

4. The method of claim 3 wherein said actuating signal is an acoustic signal in a second frequency range.

5. The method of claim 4 wherein said second frequency range further provides a simulated indirect weapon firing sound in an audible range.

6. The method of claim 1 wherein said actuating emitter generates and transmits both RF and acoustic output signals with the RF output signal serving as said actuating signal and the acoustic output signal providing a simulated weapon firing sound in an audible range.

7. The method of claim 6 wherein said detector/indicator is a MILES-type device and said degrees of effectiveness include indications of hit or near miss.

* * * * *